US009766598B2

(12) United States Patent
Matsue et al.

(10) Patent No.: US 9,766,598 B2
(45) **Date of Patent: *Sep. 19, 2017**

(54) RADIO-CONTROLLED TIMEPIECE, METHOD OF OBTAINING DATE/TIME INFORMATION, AND RECORDING MEDIUM

(71) Applicant: CASIO COMPUTER CO., LTD., Tokyo (JP)

(72) Inventors: Takeshi Matsue, Tokyo (JP); Hideo Abe, Saitama (JP); Kazuaki Abe, Saitama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 159 days.

This patent is subject to a terminal disclaimer.

(21) Appl. No.: 14/963,459

(22) Filed: Dec. 9, 2015

(65) Prior Publication Data

US 2016/0187859 A1 Jun. 30, 2016

(30) Foreign Application Priority Data

Dec. 24, 2014 (JP) ..... 2014-260370
Jun. 5, 2015 (JP) ..... 2015-114821

(51) Int. Cl.
*G04R 20/06* (2013.01)

(52) U.S. Cl.
CPC ..... *G04R 20/06* (2013.01)

(58) Field of Classification Search
CPC ..... G04R 20/00; G04R 20/02; G04R 20/04; G04R 20/06; G01S 19/25; G01S 19/254; G01S 19/256; G01S 19/258
See application file for complete search history.

(56) References Cited

U.S. PATENT DOCUMENTS 5,798,732 A 8/1998 Eshenbach
7,649,812 B2 1/2010 Baba
9,020,756 B2 4/2015 Abraham et al.
9,563,179 B2 * 2/2017 Matsue ..... G04R 20/06
9,575,468 B2 * 2/2017 Matsue ..... G04R 20/06
(Continued)

FOREIGN PATENT DOCUMENTS

JP 2009-36748 A 2/2009

OTHER PUBLICATIONS

U.S. Appl. No. 14/963,449, filed Dec. 9, 2015.

*Primary Examiner* — Amy Cohen Johnson
*Assistant Examiner* — Jason Collins
(74) *Attorney, Agent, or Firm* — Chen Yoshimura LLP

(57) ABSTRACT

A radio-controlled timepiece, including: a radio wave reception unit that receives satellite waves and extracts an incoming code sequence formatted in a prescribed format from the received satellite waves; and a processor that generates in advance an expected code sequence that is expected to be part of the incoming code sequence and detects a matching code sequence segment, within the incoming code sequence, that has a degree of match with the expected code sequence that satisfies a prescribed matching condition, the processor determining a present date/time, as indicated by the satellite waves, in accordance with a timing at which the detected matching code sequence segment occurs within the incoming code sequence as measured by time kept by the timepiece.

20 Claims, 9 Drawing Sheets

(56) References Cited

U.S. PATENT DOCUMENTS

| | | | |
|---|---|---|---|
| 2008/0074950 | A1 | 3/2008 | Rostrom |
| 2008/0253232 | A1 | 10/2008 | Irie et al. |
| 2009/0015470 | A1 | 1/2009 | Fujisawa |
| 2009/0315763 | A1 | 12/2009 | Matsuzaki |
| 2010/0159995 | A1 | 6/2010 | Stallings et al. |
| 2015/0168924 | A1 | 6/2015 | Kato |
| 2015/0185706 | A1 | 7/2015 | Hasegawa et al. |
| 2015/0212495 | A1 | 7/2015 | Kato |
| 2016/0187858 | A1 | 6/2016 | Matsue et al. |
| 2017/0123383 | A1 | 5/2017 | Matsue et al. |

* cited by examiner

RADIO-CONTROLLED TIMEPIECE, METHOD OF OBTAINING DATE/TIME INFORMATION, AND RECORDING MEDIUM

BACKGROUND OF THE INVENTION

The present invention, in one aspect, relates to a radio-controlled timepiece, a method of obtaining date/time information, and a storage medium.

Conventionally, there are electronic watches (radio-controlled timepieces) that accurately maintain the date/time that the watch counts by receiving radio waves from a navigation satellite (positioning satellite) of GNSS (global navigation satellite system) and obtaining date/time information therefrom. Such a radio-controlled timepiece does not require manual operation by the user and can count date/time at various locations in the world and accurately maintain the displayed date/time.

However, in an electronic watch, the load involved in receiving satellite waves is significantly greater than the load involved in counting and displaying date/time. Dealing with the reception of satellite waves gives rise to the problem of increased battery size and other associated problems such as increase in the size and weight of the electronic watch. To address such problems, various types of technologies for reducing energy consumption have been developed so far.

One of such technologies for reducing energy consumption includes shortening the time required for receiving radio waves. Japanese Patent Application Laid-Open Publication No. 2009-36748 discloses a technology that receives a predefined portion of the signal including date/time information according to a signal format (navigation message) transmitted by the GPS satellites and that temporarily pauses reception while the GPS satellites are transmitting unnecessary information, for example.

In this process, to avoid misidentifying date/time, parity data for the data block that includes the predefined portion of the signal described above is obtained to ensure the integrity of the incoming data.

However, in adverse reception condition such as when the signal strength of the received radio waves is low, the watch can misidentify part of the incoming codes. In a case like this, on one hand, a situation in which imprecise date/time is obtained needs to be avoided. On the other hand, however, if the reception is continued until the watch verifies all of the obtained code sequences, the reception time becomes longer, which lowers the efficiency of obtaining the date/time information and increasing the consumption of unnecessary power.

SUMMARY OF THE INVENTION

An aim of the present invention is to provide a radio-controlled watch that can obtain accurate date/time information more efficiently, a method of obtaining date/time information, and a program.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a radio-controlled timepiece, including: a radio wave reception unit that receives satellite waves and extracts an incoming code sequence formatted in a prescribed format from the received satellite waves; and a processor that generates in advance an expected code sequence that is expected to be part of the incoming code sequence and detects a matching code sequence segment, within the incoming code sequence, that has a degree of match with the expected code sequence that satisfies a prescribed matching condition, the processor determining a present date/time, as indicated by the satellite waves, in accordance with a timing at which the detected matching code sequence segment occurs within the incoming code sequence as measured by time kept by the timepiece.

It is to be understood that both the foregoing general description and the following detailed description are exemplary and explanatory, and are intended to provide further explanation of the invention as claimed.

DETAILED DESCRIPTION OF EMBODIMENTS

Below, embodiments of the present invention will be described with reference to the drawings.

Figure 1:
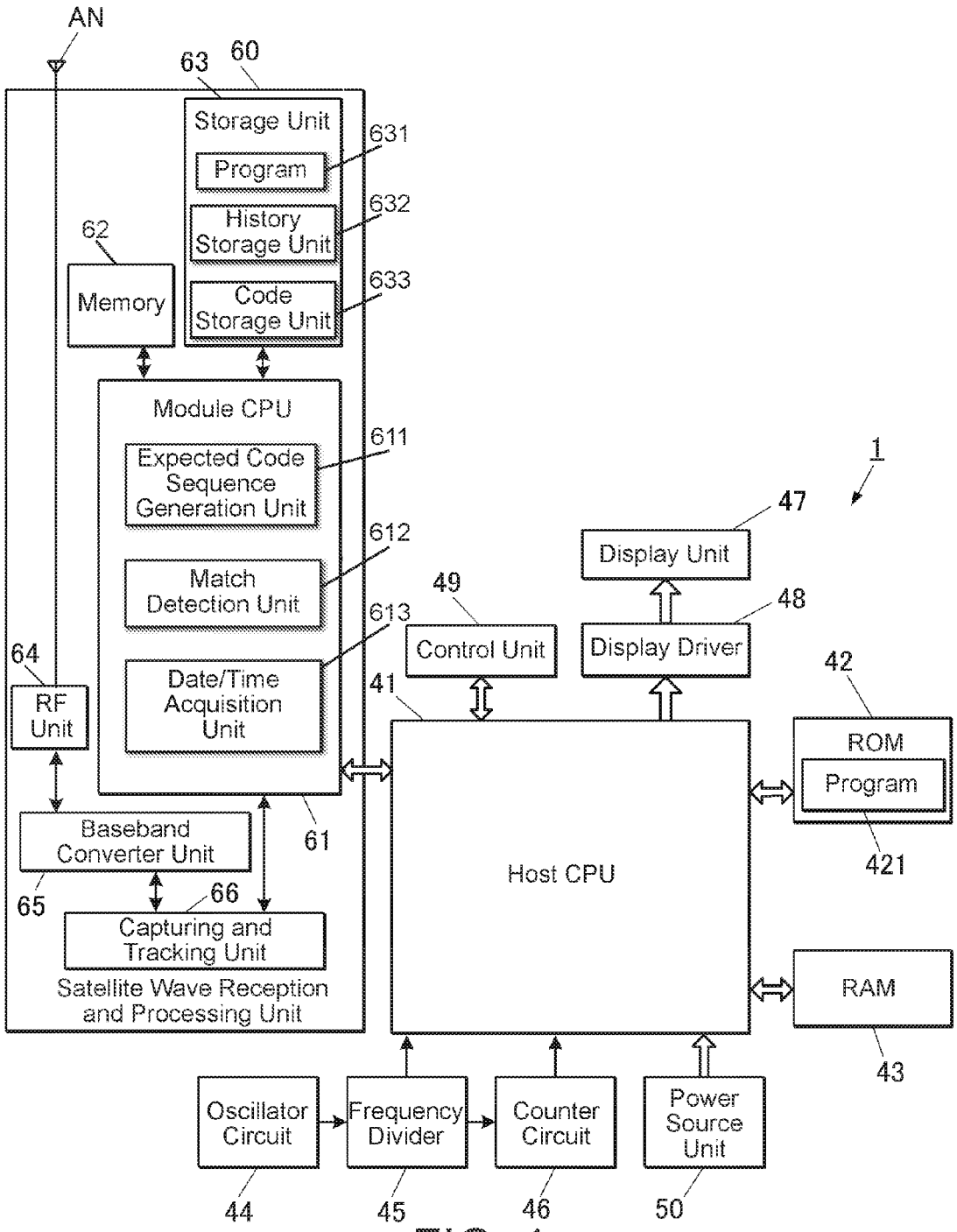
FIG. 1 is a block diagram showing an electronic watch according to embodiments of the present invention.

FIG. 1 is a block diagram showing a functional configuration of an electronic watch 1 according to Embodiment 1, which is a positioning device and a radio-controlled timepiece of the present invention.

The electronic watch 1 is a radio-controlled timepiece that can receive radio waves from at least American positioning satellites (referred to as the GPS satellites below) of GPS (global positioning system) and obtain date/time information.

The electronic watch 1 includes a host CPU 41 (central processing unit), a ROM 42 (read only memory), a RAM 43 (random access memory), an oscillator circuit 44, a frequency divider 45, a counter circuit 46 that function as a counter unit, a display unit 47, a display driver 48, an operation unit 49, a power source unit 50, a satellite wave reception and processing unit 60 (processor), an antenna AN, and the like.

The host CPU 41 carries out various types of arithmetic processing and controls the overall operation of the electronic watch 1. The host CPU 41 reads out control programs from the ROM 42, loads the programs to RAM 43, and executes various types of operation processing such as arithmetic control and display involved in displaying date/time and other various functions. Furthermore, the host CPU 41 instructs the satellite wave reception and processing unit 60 to operate and receive radio waves from the positioning satellites and obtain date/time information and location information computed based on the received content.

The ROM 42 is a mask ROM, a rewritable non-volatile memory, or the like, and stores control programs and initial configuration data. The control programs include a program 421 used to control various types of processes for obtaining various types of data from the positioning satellites.

The RAM 43 is a volatile memory such as SRAM or DRAM. The RAM 43 stores data temporarily by providing working memory space for the host CPU 41 and stores various types of configuration data. The various types of configuration data include the settings for the home city where the electronic watch 1 is used and the settings related to whether daylight savings time should be implemented when computing and displaying date/time. A part or the whole of the various types of configuration data stored in the RAM 43 may be stored in a non-volatile memory.

The oscillator circuit 44 generates and outputs a predetermined frequency signal. A crystal oscillator is used in the oscillator circuit 44, for example.

The frequency divider circuit 45 takes an input frequency signal from the oscillator circuit 44 and generates an output frequency signal used by the counter circuit 46 and the host CPU 41. It may be possible for the frequency of this output signal to be changed on the basis of the settings of the host CPU 41.

The counter circuit 46 measures the current date/time by counting the input count of the prescribed frequency signal (clock signal) inputted from the frequency divider 45 and adding that value to the default value. The counter circuit 46 may be a unit that changes the value stored in the RAM using software or may be equipped with a dedicated counter circuit. Although there is no particular limit to the date/time counted by the counter circuit 46, it is either the cumulative time measured from a predefined timing, UTC date/time (coordinated universal time), the date/time of the home city set in advance, or the like. The date/time measured by the counter circuit 46 does not always need to be kept in "year month day, hour minute second" format. A clock signal inputted into the counter circuit 46 from the frequency divider circuit 45 is slightly off from the precise pace at which time passes. The magnitude of the error (rate) per day changes depending on operating conditions and temperature and is normally within +/−0.5 seconds.

The display unit 47 includes a display screen such as a liquid crystal display (LCD) or an organic EL (electroluminescent) display and executes digital display operations related to date/time and various types of functions by using dot matrix display, segment display, or a combination thereof.

Based on a control signal from the host CPU 41, the display driver 48 outputs a driver signal that matches the type of the display screen to the display unit 47, thereby instructing the display unit to perform display on the display screen.

The operation unit 49 receives an input operation by the user and outputs to the host CPU 41 an electronic signal that corresponds to the input operation as an input signal. The operation unit 49 includes a push-button switch or a crown, for example.

Alternatively, the display unit 47 and the operation unit 49 may be integrated. This integration can be achieved by first mounting the touch sensor on the display screen of the display unit 47, and second by enabling the display screen to function as a touch panel that outputs operation signals that correspond to contact point and contact manner involved in the contact behavior of the user detected by the touch sensor.

The power source unit 50 includes batteries and provides power needed in the operation of the electronic watch 1 to respective units of the watch at a given voltage. A solar panel and a rechargeable battery are used as the batteries for the power source unit 50. The solar panel generates electromotive force using incident light and supplies power to various units such as the host CPU 41. Also, when the solar panel generates surplus power, the power is stored in the rechargeable battery. When the possible amount of power that the solar panel can generate based on the amount of incident light available from an external source is less than the amount of power being consumed, the secondary battery supplies power. Alternatively, a non-rechargeable battery such as a button battery can be used as the battery.

The satellite wave reception and processing unit 60 is tuned to the radio waves from the positioning satellites via the antenna AN and receives the radio waves by identifying and capturing a C/A code (pseudo random noise) unique to each of the positioning satellites. Then, the satellite wave reception and processing unit demodulates and decodes navigation messages sent by the positioning satellites to obtain necessary data. The satellite wave reception and processing unit 60 includes a module CPU 61 (a processor including an expected code sequence generation unit 611, a match detection unit 612, a date/time acquisition unit 613), a memory 62, a storage unit 63, an RF unit 64, a baseband converter unit 65, an capturing and tracking unit 66, and the like. The module CPU 61 includes the expected code sequence generation unit 611, the match detection unit 612, and the date/time acquisition unit 613. The expected code sequence generation unit 611, the match detection unit 612, and the date/time acquisition unit 613 may be a single CPU, there may be a separate CPU for carrying out each operation, or each operation can be carried out by the host CPU 41.

The module CPU 61 controls the operations of the satellite wave reception and processing unit 60 according to control signals and configuration data input from the host CPU 41. The module CPU 61 reads out the necessary programs and configuration data from the storage unit 63, operates the RF unit 64, the baseband converter unit 65 and the capturing and tracking unit 66, and receives and demodulates the radio waves from respective positioning satellites to obtain the date/time information. In addition to obtaining the date/time information by decoding the received radio waves, the module CPU 61 can compare and match the demodulated and identified incoming code sequence with a code sequence set in advance for comparison (comparison code sequence), without decoding the incoming code sequence, to see if the two code sequences agree.

The memory 62 is a RAM that provides working memory space for the module CPU 61 in the satellite wave reception and processing unit 60. Also, the memory 62 temporarily stores the code sequence data that is generated and used to contrast and compare with the incoming code sequence.

The storage unit 63 stores various types of configuration data used in GPS positioning and the history of position measurements. Various types of non-volatile memories such as flash memory or EEPROM (electrically, erasable and programmable read-only memory) are used for the storage unit 63. Data stored in the storage unit 63 includes orbital information (ephemeris), approximate orbital information (almanac), and the date/time of prior measurements as well as the locations of satellites at the time of those measurements. In addition, the storage unit 63 stores, as a time difference table, data about different time zones around the world and whether daylight saving time is in effect. When the position measurement is taken, the time difference table is used as a reference to determine local time data such as the time difference between the coordinated universal time (UTC) in the standard time obtained at the current location or the data about whether daylight saving time is in effect.

The data stored in the storage unit 63 include programs 631, the history storage unit 632, and the code storage unit 633. The programs 631, the history storage unit 632, and the code storage unit 633 may be a single storage unit, a separate storage unit may be provided for each unit, or the programs 631 may be included in the data stored in the ROM 42, and the history storage unit 632 and the code storage unit 633 may be included in the data stored in the RAM 43. When obtaining date/time information and performing positioning measurements, the module CPU 61 reads out and executes the programs 631. When executing the programs 631, the module CPU refers to and uses the history storage unit, which stores the most recent reception history, and the code storage unit 633, which stores data about the code sequences (logged code sequences) that are identified during the most recent reception.

The RF unit 64 receives satellite waves in L1 frequency (1.57542 GHz for the GPS satellites), selectively filters and amplifies the incoming signal from the positioning satellites, and converts the incoming signal to the intermediate frequency. The RF unit 64 includes an LNA (low noise amplifier), a BPF (band pass filter), a local oscillator, a mixer, and the like.

By applying the C/A code of the respective positioning satellites to the intermediate frequency obtained by the RF unit 64, the baseband conversion unit 65 acquires the baseband signal, or in other words the code sequence (incoming code sequence) in a navigation message (in a prescribed format).

The capturing and tracking unit 66 computes respective correlation values of the C/A code of the respective positioning satellites at respective phases with respect to the intermediate frequency signal obtained by the RF unit 64. By determining the peak correlation value, the capturing and tracking unit 66 identifies the signal that is being received from the positioning satellites and the phase of the signal. The capturing and tracking unit 66 also sends feedback about the phase data to the baseband conversion unit 65 in order to continuously acquire the code sequences in the navigation messages from the positioning satellite by using the C/A code of the identified positioning satellite and the phase of the C/A code.

The wave reception unit is constituted by the RF unit 64, the baseband conversion unit 65, and the capturing and tracking unit 66.

The power source unit 50 supplies power directly to the satellite wave reception and processing unit 60 and is turned ON and OFF by a control signal from the host CPU 41. In other words, the satellite wave reception and processing unit 60 is turned OFF when the unit is not receiving radio waves from the positioning satellites or performing computational operations involved in obtaining date/time or determining satellite position, separately from units that are always in operation such as the host CPU 41. Also, it is possible to switch, based on an input operation to the operation unit 49, the satellite wave reception and processing unit 60 according to the present embodiment to go into airplane mode, which is a setting used to control use of radio waves during flight. In airplane mode, the host CPU 41 blocks the satellite wave reception and processing unit 60 from turning ON. Alternatively, in airplane mode, just the radio waves reception operation in the satellite wave reception and processing unit 60 may be blocked.

Now, the format of the navigation message sent from the GPS satellites is described.

GNSS is a system in which a plurality of positioning satellites are distributed in a plurality of orbits. The system enables signals from the plurality of different positioning satellites to be simultaneously received at respective locations on the surface of the earth. By obtaining information about the real-time satellite positions and date/time information that are sent from four or more positioning satellites (only three satellites are needed if an object to be located is assumed to be on the surface of the earth), it becomes possible to determine the coordinate position in three-dimensional space of the satellites and date/time. This determination is based on the acquired data and the error in the timing of data acquisition, or in other words the difference in how long the signal from the respective positioning satellites takes to travel (distance).

The positioning satellites transmit date/time information, satellite location information, and status information such as the health of the satellites, all of which are encoded in a prescribed format. This information is transmitted by a spread spectrum technique using a C/A code (pseudo-random noise). Each satellite navigation system sets its own signal transmission format (navigation message format).

Figure 2:
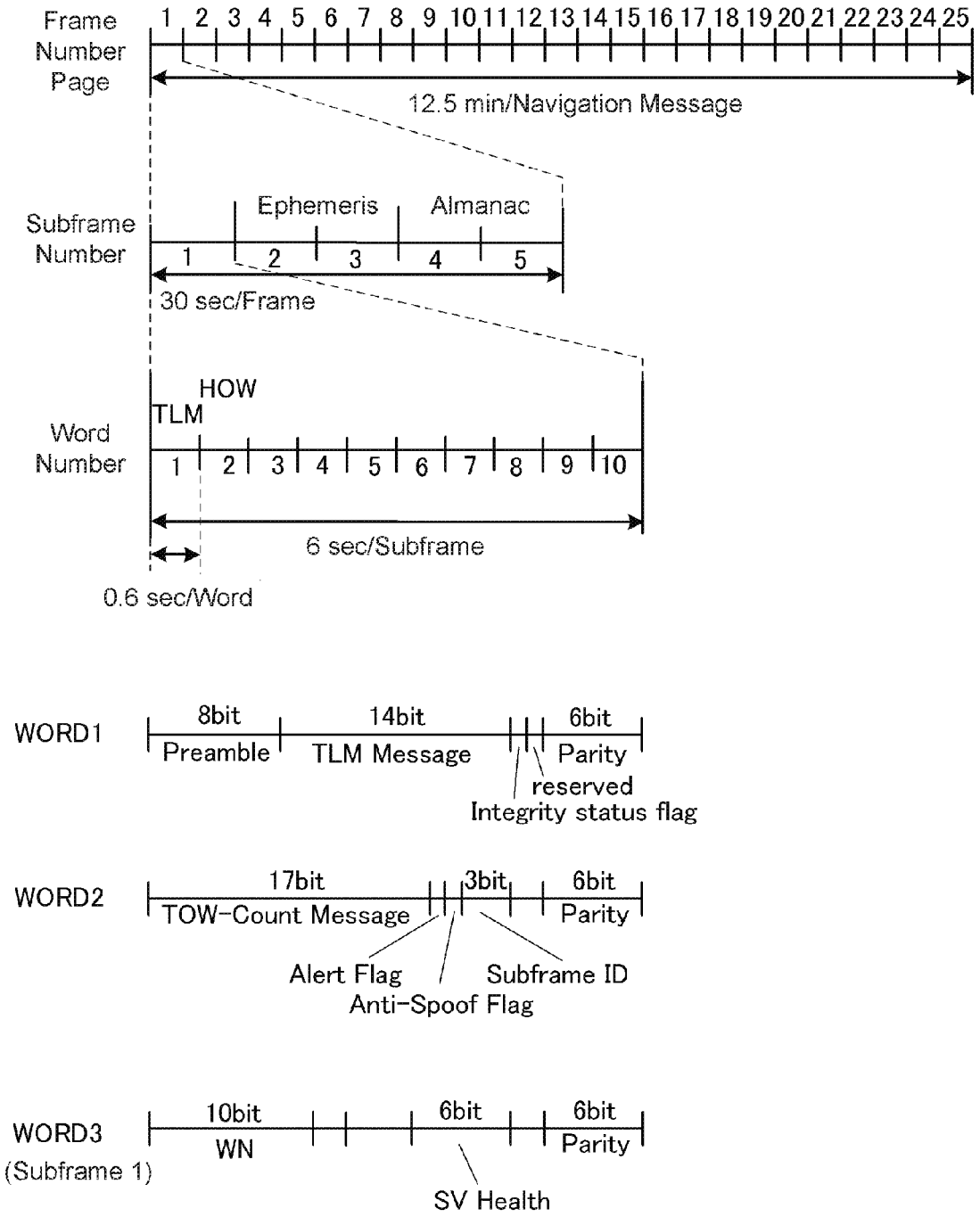
FIG. 2 is a view describing a format of navigation message sent by the GPS satellites.

FIG. 2 is a view used to describe the format of navigation message transmitted from the GPS satellites.

In GPS, each of the GPS satellites transmits a total of 25 pages of data frames, each of which is 30-seconds long, and outputs the entire navigation message in a period of 12.5 minutes. In GPS, each of the GPS satellites uses a unique C/A code. A C/A code contains 1023 code bits (chips) and is transmitted at 1.023 MHz with a period of 1 ms. The beginning of the chip sequence is synchronized with the internal clock of the GPS satellites. By detecting a phase shift of each GPS satellite, the signal travel time is detected.

5 subframes (6 seconds) constitute each of the data frames. 6-seconds-long date/time information and an invariant code sequence, which is constant and does not depend on transmission period, are transmitted in each of the subframes, which has a period of 6 seconds (transmission period). Ten words (each 0.6 seconds long, word 1 to word 10 in that order) constitute each of the subframes. The data format in word 1 and word 2 is the same in all subframes. In word 1, the first 8 bits contains a preamble, which is an invariant code sequence, followed by a 14-bit TLM message. After this, 1-bit integrity status flag, 1-bit reserved bit, and 6-bit parity data are arranged. Word 2 begins with 17-bit TOW-count (also known as Z-count) that indicates the time elapsed since the beginning of the GPS week, which is 6-seconds-long date/time information, followed by an alert flag and an anti-spoof flag each having 1-bit. Then, in word 2, the subframe ID, which indicates the subframe number (period number), is represented by 3-bits. After this, 2 bits used for matching parity data is arranged followed by 6-bit parity data. Similar to a TOW count, a subframe ID is a code sequence that change with a period of 6 seconds (in accordance with a prescribed correspondence relationship between the two code sequences) (correspondence code sequence portion). Thus, the consistency between a subframe ID and a TOW count can be used as time-relevant information for verifying the date/time.

Different subframes contain different data after word 3. Word 3 of subframe 1 begins with the 10-bit WN (week number). Subframes 2 and 3 mainly include the ephemeris (precise satellite orbital information), and part of subframe 4 and subframe 5 transmit the almanac (approximate orbital information).

Next, operations involved in acquiring date/time information in the electronic watch 1 according to the present embodiment are described.

The electronic watch 1 according to the present embodiment generates in advance an expected code sequence, which the unit expects to receive based on the date/time counted by the counter circuit 46 and the code sequence that was obtained most recently. This code sequence is compared with each of the code sequences that are sequentially received and identified (incoming code sequences). When a portion for which the degree of match satisfies a reference condition is detected singularly, the electronic watch identifies the timing of obtaining estimated date/time of the expected code sequence based on the reception timing of the incoming code sequence that is detected (match timing). Here, this reference condition means that the mismatched code count included in the comparison result is set in proportion to the probability that code sequences that have the same mismatched code count as above appear, are obtained, and are compared at a timing that differs from the predicted reception timing. The mismatched code count is set such that it has a sufficiently low value that corresponds to the number and frequency of use and the like of the electronic watch 1.

Incoming code sequences can be compared with the expected code sequence in the following way. First, an incoming code sequence that has the same number of code bits (bit count) as the expected code sequence contains from its beginning to end can be set. Second, as one bit of the code bits becomes identified, the newly identified bit replaces the oldest one bit, and a code in which the beginning of the code sequence is shifted can be defined. In this way, a series of incoming code sequences can be sequentially compared with the expected code sequence. The comparison is performed by the module CPU 61, but a hardware configuration such as a matched filter in the capturing and tracking unit 66 may also be used. Also, a long code sequence may be identified in advance, and the comparison with the expected code sequence may be carried out while shifting the range of the long code sequence that corresponds to the incoming code sequence. In this case, the timing when the beginning of the long code sequence was received may be stored, and the match timing may be set by shifting the reception timing according to code location where the match with the expected code sequence was detected.

Code sequences that can be used in the expected sequence include a part or whole of the following: the permanently fixed code sequences such as a preamble or reserved bits, the codes that can be calculated from date/time such as a TOW count, WN, or a subframe ID, codes that are not changed normally but can have problems for use when they are changed such as an alert flag or an anti-spoof flag, or codes for which an update is not expected within a short elapsed time measured from when the latest information such as a telemetry message and approximate orbital information (almanac) is obtained. In this case, the expected code sequence does not need to be a code that is transmitted continuously. The expected code may be set by skipping codes that are difficult to predict and separating the sequence into multiple parts. The expected code sequence may be generated by removing the last 6 bits (parity) of word 1 from the bits between the first bit of word 1 and the 22nd bit of the word 2 (the least significant bit of the subframe ID), for example.

An invariant code sequence and flag bits may be used regardless of the last reception condition or the interval between receptions.

Assuming that the maximum error that occurs in the counter circuit 46 is about 0.5 seconds per day, the error in date/time can be estimated to be within ±3 seconds that correspond to the length of one subframe as long as the time that has elapsed since the date/time was adjusted is less than or equal to 6 days. Thus, within this error range, it becomes possible to predict code sequences such as a TOW count or a subframe ID, which are included in the subframe that is received based on the date/time of the counter circuit 46.

The code sequences such as a telemetry message and approximate orbital information normally do not change in a short interval (less than one day, for example). Thus, these code sequences that are identified in the most recent reception can be stored as past code sequences in the code storage unit 633. For each type of information, whether these past code sequences are usable can be determined according to criteria such as the elapsed time since the last reception, which can be obtained by comparing the last reception history stored in the history storage unit 632 with the date/time counted by the counter circuit 46. Then, these code sequences can be used appropriately.

The shorter the expected code sequence is, the quicker the reception is completed, and the number of times the codes unrelated to the date/time information becomes identified decreases. However, the length of the expected code sequence needs to be long enough to avoid misidentification, or in other words to prevent a situation in which a code sequence that is identical or similar to the expected code sequence appears in a location other than the location where the expected code sequence is expected to appear, which leads the electronic watch to determine that a match for the expected code sequence was found, thereby failing to fulfill the reference condition described above. Suppose that each of the binary codes is arranged randomly as either 0 or 1 each with a probability of ½. In this case, the upper limit for the mismatch count (reference mismatch count) and the length of the expected code sequence are set such that the probability of misidentification that corresponds to the mismatch count between each of the code bits in the expected code sequence and each of the code bits in the incoming code sequence is below the value required by the electronic watch 1 (the third reference value).

With respect to an expected code sequence that is 44-bits long, the probability of occurrence of a code sequence that has 3-bits of mismatches is ${}_{44}C_3/2^{44}=7.53\times10^{-10}$, for example. With respect to an expected code sequence that is 28-bits long, the probability of occurrence of a code sequence that has 1-bit mismatch is ${}_{28}C_1/2^{28}=1.04\times10^{-7}$, for example.

Figure 3:
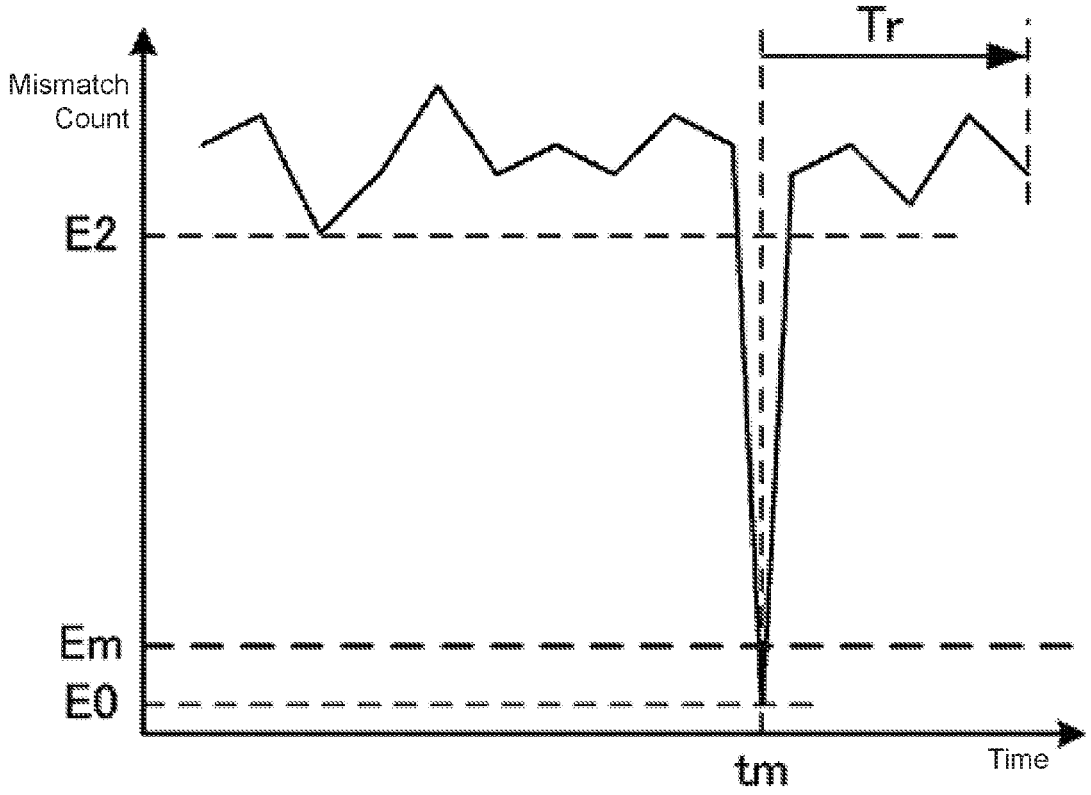
FIG. 3 is a graph schematically showing the change in mismatch counts between the expected code sequence and the incoming code sequence.

FIG. 3 is a graph schematically showing how the mismatch count between the expected code sequence and the incoming code sequence changes.

Many of the different code bits in the code sequence of the navigation message are not correlated to one another. Thus, when the expected code sequence and the incoming code sequence in different phases are compared with each other, roughly a half of the code bits are expected to not match under normal circumstances. In contrast, at the timing when the expected code sequence matches with the incoming code sequence, mismatched code count E suddenly drops to 0 or a very small value. By detecting the timing when mismatch count E falls below the reference value Em, which is referred to as tm, the candidate for match timing is obtained. This reference value Em is set based on the probability of occurrence of the code sequence that has the mismatch count described above. To set the probability of occurrence to be less than $10^{-9}$, the reference value Em, as described above, can be set equal to 3 with respect to a 44-bit-long expected code sequence, for example.

Also, this probability of occurrence may be set based further on product life cycle and the estimated frequency of receiving satellite waves, and the bit length of the expected code sequence and the reference value Em may be set accordingly.

Here, the TOW count can be 0 (all of the code bits in the TOW count are 0) or be near the maximum value (all of the code bits in the TOW count are 1). If the TOW count has these values and this code sequence is used as a part or whole of the expected code sequence, the code bits in the portion that the expected code sequence and the incoming code sequence overlap will match, even when the expected code sequence and the incoming code sequence are slightly out of phase. Also, when the TOW count and the like are periodic code sequences (0s and 1s are alternately arranged, for example), the code bits in those code sequences that are out of phase by a multiple of the period will match. Thus, in this case, the mismatch count becomes smaller compared to the situation in which there is a normal phase shift. As a result, the mismatch count can become smaller, depending on how the expected code sequence is determined, than the reference value Em when there is a phase shift, which possibly leads to a misidentification.

The electronic watch 1 according to the present embodiment calculates the mismatch count by shifting the beginning of the incoming code sequence one bit by one bit with respect to the beginning of the expected code sequence. This calculation begins when the comparison with the expected code sequence begins. At some point, the candidate for match timing is obtained. After this point, the calculation further continues until the electronic watch identifies a prescribed bit count, which corresponds to the time interval Tr in FIG. 3, during which 5 bits of codes are identified. Then, the probability of occurrence (first probability of occurrence) of mismatches at the timing of the candidate for match timing (first mismatch count) and the probability of occurrence (second probability of occurrence) of mismatches that is second smallest after the first mismatch count with in the comparison range (second mismatch count) can be calculated. The ratio of these two probabilities is calculated as the risk factor of misidentification. When this risk factor is less than the predetermined reference risk factor (the first reference value), the watch determines that the match timing is detected correctly and adjusts the date/time.

In this situation, as described above, for some expected code sequences, even though an incoming code sequence that perfectly matches the expected code sequence at the correct match timing is obtained (mismatch count is 0), the electronic watch can fail to determine this timing as the match timing. To address this problem, when the mismatch count is 0, the risk factor can be set below the reference risk factor by calculating the risk factor assuming the probability of occurrence of the mismatch count to be 0.

Figure 4:
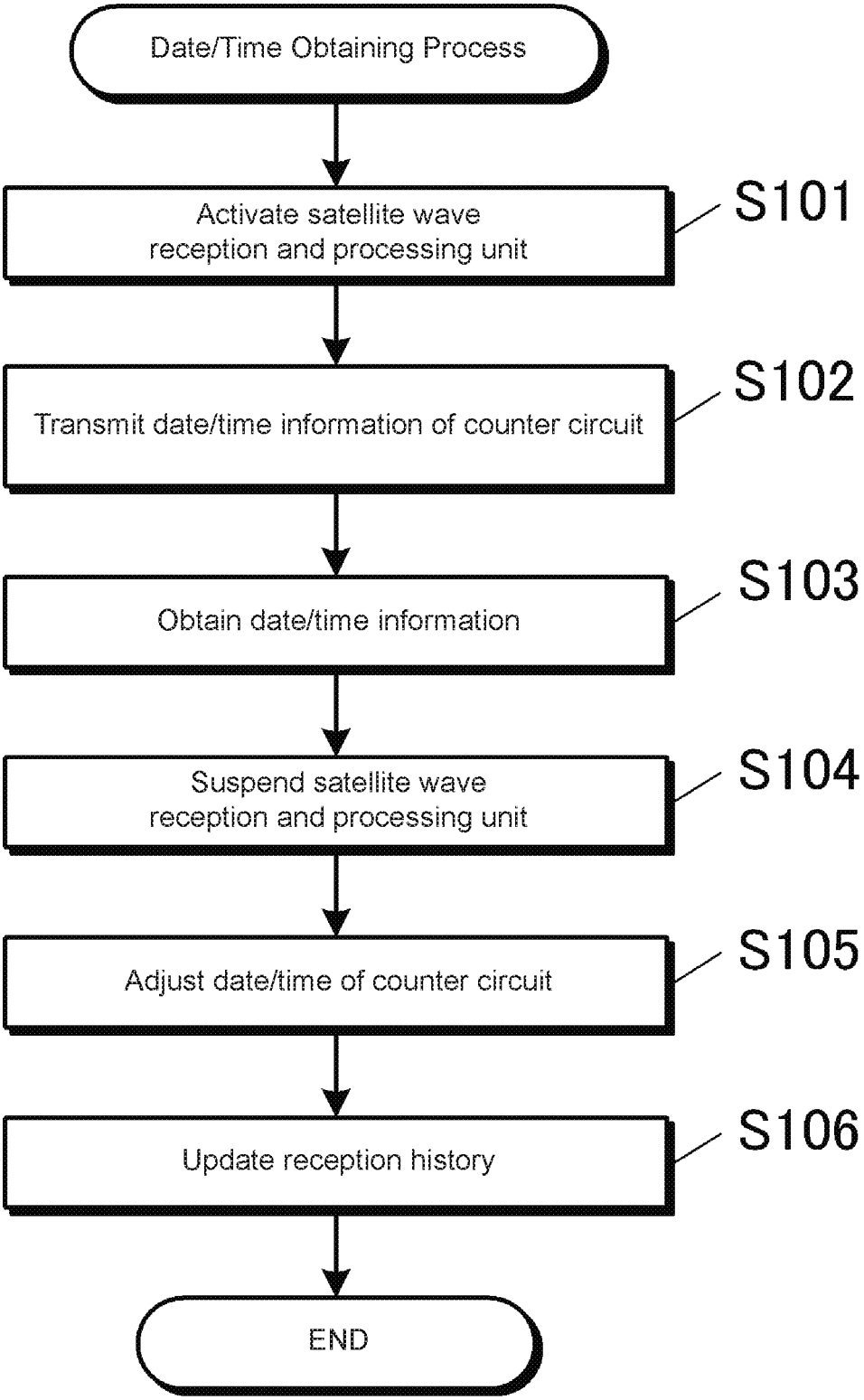
FIG. 4 is a flowchart showing control steps for a date/time obtaining process.

FIG. 4 is a flowchart showing control steps involved in the date/time obtaining process by the host CPU 41 in the electronic watch 1 according to the present embodiment.

The date/time obtaining process is activated either when an input operation of executive instruction by the user to the operation unit 49 is detected or when criteria such as the preset reception time or the reception timing are met.

Once the date/time obtaining process begins, the host CPU 41 activates the satellite wave reception and processing unit 60 (step S101). The host CPU 41 sends to the satellite wave reception and processing unit 60 two pieces of information: one about the setting that indicates that the object of the initial data retrieval is date/time information, another about the date/time counted by the counter circuit 46 (step S102). Then, the host CPU 41 is put on standby for data output from the satellite wave reception and processing unit 60. During the standby, the host CPU 41 may instruct the display unit 47 to show that the host CPU 41 is receiving data.

After receiving a signal from the satellite wave reception and processing unit 60, the host CPU 41 obtains date/time data (step S103). Then, the host CPU 41 suspends the satellite wave reception and processing unit 60 (step S104) and adjusts the date/time counted by the counter circuit 46 (step S105). The host CPU 41 updates the reception history stored in the RAM 43 (step S106). With that, the host CPU 41 ends the date/time obtaining process.

Figure 5:
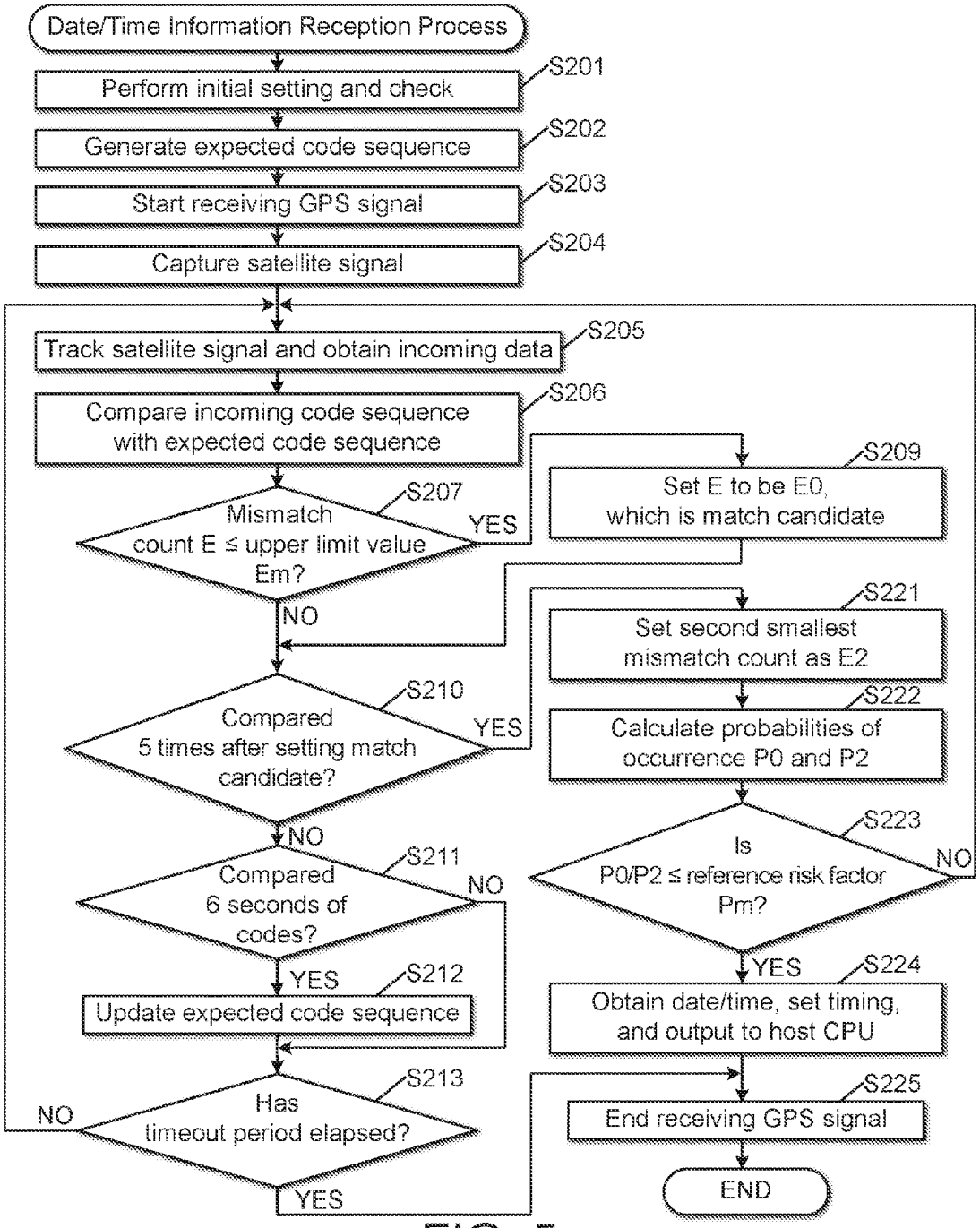
FIG. 5 is a flowchart showing control steps for a date/time information reception process.

FIG. 5 is a flowchart showing control steps involved in the date/time information reception process by the module CPU 61 in the electronic watch 1 according to the present embodiment.

The date/time information reception process is activated when the host CPU 41 activates the satellite wave reception and processing unit 60 and the data outputted from the host CPU 41 in the processing involved in step S102 is date/time data.

Once the date/time information reception process is started, the module CPU 61 conducts an initial setting and an operation check. The module CPU 61 obtains the date/time information outputted from the host CPU 41 in the processing involved in step S102 and then determines the contents of the navigation message to be received and the start timing and the duration of the reception of the determined content (step S201). Here, the module CPU 61 may obtain the previous reception timing from the storage unit 63 and switch to the normal 3-word reception depending on the time elapsed from the previous reception timing.

The module CPU 61 generates the expected code sequence for the part of the code sequence that needs to be identified during the set reception period (step S202). When it is possible to change the length and location of the expected code sequence, the module CPU 61 obtains from the storage unit 63 the settings that are relevant to the change and generates an appropriate expected code sequence. The module CPU 61 begins to receive radio waves from a GPS satellite at an appropriate timing (step S203) and captures the radio waves from the GPS satellite that can be captured (step S204). The module CPU 61 attempts to use the reverse spread spectrum technique by applying the C/A code of the respective GPS satellites to the signal obtained from the received waves while shifting the phase of the C/A code and to detect and capture the signal from the GPS satellite.

Once the signal from a GPS satellite is captured, the module CPU 61 demodulates the signal while tracking the GPS satellite and obtains the code sequence of the received data (incoming code sequence) (step S205). The module CPU 61 compares the prescribed bit length that corresponds to the array width of the expected code sequence in the received data with the generated expected code sequence and counts the code mismatch count E (step S206). The mismatch count E that is counted is stored together with the timing information. The module CPU 61 determines whether the mismatch count E is below the reference value Em (step S207). If the mismatch count E is determined to be smaller than the reference value Em ("YES" in step S207), the module CPU 61 sets this timing as the candidate for match timing and sets the mismatch count E to be the candidate for the smallest mismatch count E0 (first mismatch count) (step S209). Then, the processing sequence of the module CPU 61 moves onto step S210. If the mismatch count E is determined to be not less than the reference value Em ("NO" in step S207), the processing sequence of the module CPU 61 moves onto step S210.

Suppose that the process in step S207 determines that a comparison result in which the mismatch count E is less than the reference value Em is obtained when the match candidate is already set. In that case, only when the new mismatch count is smaller than the mismatch count of the match candidate, the new count may overwrite the old count and be set as the match candidate, for example. At this point, the obtained bit count and the comparison count after the match candidate is set in the process in step S210 are initialized to 0.

Alternatively, in this case, the module CPU 61 may suspend the acquisition of date/time by comparing code sequences and switch to conventional methods of obtaining date/time such as the 3-word reception method, for example.

Once in the process in step S210, the module CPU 61 further obtains 5 bits of data after the candidate for match timing is set and determines whether each of the 5 bits was compared with the expected code sequence (step S210). If it is determined that 5 bits of data are not obtained and compared ("NO" in step S210), the module CPU 61 determines whether six seconds (transmission period that corresponds to one subframe) of data have been compared since the beginning of the period to which the expected code sequence corresponds (step S211). If it is determined that 6 seconds of data have not been compared ("NO" in step 211), the process in the module CPU 61 moves onto step S213.

If it is determined that 6 seconds of data have been compared ("YES" in step S211), the module CPU 61 generates a new expected code sequence that corresponds to the next subframe (or in other words, an expected code sequence that is based on the time after the transmission period of the current subframe) and conducts an update (step S212). Then, the process of the module CPU 61 moves onto step S213.

Once in the process in step S213, the module CPU 61 determines whether the time elapsed since starting the reception has been longer than timeout period (step S213). The timeout period may be set to the time interval that corresponds to a predetermined multiple of subframes or the like and changed appropriately according to the battery capacity at the start of the reception or the elapsed time since the last reception. If it is determined that the timeout period has not elapsed ("NO" in step S213), the process in the module CPU 61 goes back to step S205 and continues to obtain the incoming data. If it is determined that the timeout period has elapsed ("YES" in step S213), the process of the module CPU 61 moves on to step S225.

If the determination process in step S210 determines that 5 bits of data have been obtained after the candidate for match timing was set and each of the bits have been compared with the expected code sequence ("YES" in step S210), the module CPU 61 sets the mismatch count that is determined to be the second smallest in the time interval between when the reception starts (if a comparison has been performed for longer than or equal to 6 seconds, use most recent 6-second interval, for example) and when 5 comparisons are completed as the comparison mismatch count E2 (second mismatch count) (step S221). The module CPU 61 calculates the probabilities of occurrence P0 and P2 that corresponds to the smallest mismatch count E0 and the comparison mismatch count E2, respectively (step S222).

The module CPU 61 determines whether the risk factor Pd, which is calculated by the ratio of the probabilities of occurrence P0 and P2, P0/P2, is less than the reference risk factor Pm (step S223). If the risk factor Pd is determined to be not less than or equal to the reference risk factor Pm (greater than the reference risk factor Pm) ("NO" in step S223), the module CPU 61 clears the settings about the candidate for match and returns the process to step S205.

If it is determined that the risk factor Pd is less than or equal to the reference risk factor Pm ("YES" in step S223), the module CPU 61 takes the candidate for match timing as the official match timing, sets the official date/time based on the estimated reception date/time of the expected code sequence and the match timing, and adjusts the timing before outputting to the host CPU 41 (step S224). The module CPU 61 stops receiving the radio waves from the GPS satellite (step S225) and ends the date/time information reception process.

Modification Example 1

Figure 6:
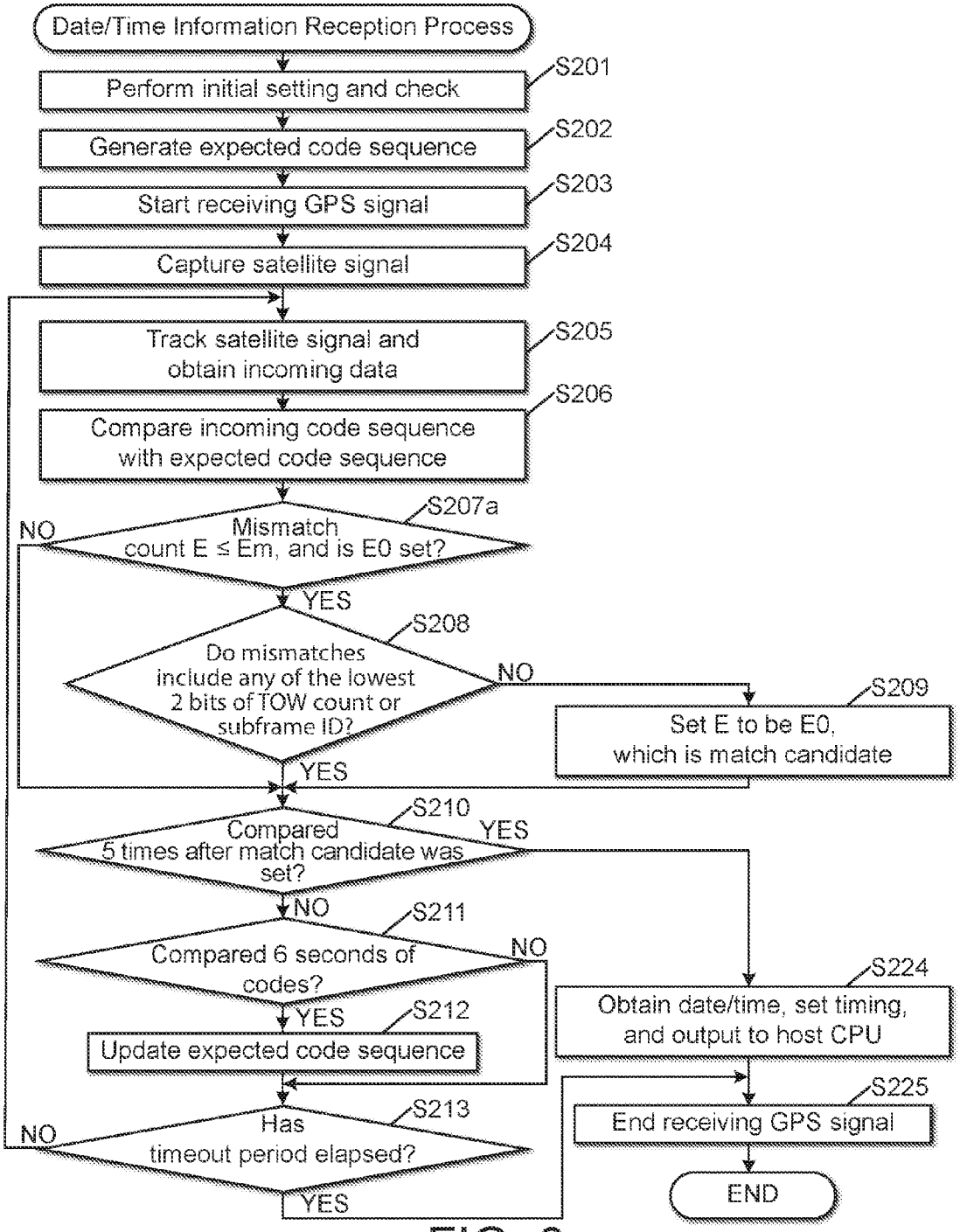
FIG. 6 is a flowchart showing Modification Example 1 of the control steps for the date/time information reception process.

FIG. 6 is a flowchart showing Modification Example 1 of the date/time information reception process.

In the date/time information reception process of Modification Example 1, the process in step S207 of the date/time information reception process according to the embodiment described above is changed to step S207*a* and step S208 is added. The processes in Modification Example 1 are the same, except the fact that step S221 to S223 are removed, and processing contents similar to those of the embodiment described above are assigned the same reference characters and descriptions thereof are omitted.

The date/time information reception process of Modification Example 1 always includes a TOW count or a subframe ID in the expected code sequence.

In the date/time information reception process, after the code bits in the incoming code sequence are compared with the code bits in the expected code sequence (step S206), the module CPU 61 determines whether the mismatch count E is smaller than or equal to the candidate for the smallest mismatch count E0 along with whether the mismatch count E is less than or equal to the reference value Em when the candidate for the smallest mismatch count E0 is set (step S207*a*). Suppose that the mismatch count E is less than or equal to the reference value Em and that the candidate for the smallest mismatch count E0 is not set. If it is set, suppose that the mismatch count E is less than or equal to the candidate for the smallest mismatch count ("YES" in step S207*a*). In this case, whether the mismatched codes include any of the lowest 2 bits of the TOW count or any of the 3 bits of the subframe ID (at least a prescribed number of code bits counted from the side of the least significant bit) is further determined (step S208). If it is determined that any of the bits are included ("YES" in step S208), the process in the module CPU 61 moves onto step S210. If it is determined that none of the bits are included ("NO" in step S208), the process in the module CPU 61 moves on step S209.

If it is determined that the mismatch count E is not less than or equal to the reference value Em or the candidate for the smallest mismatch count E0 when this value is set ("NO" in step S207*a*), the process in the module CPU 61 moves on step S210.

In this step, if the lowest two bits of the TOW count and the subframe ID are synchronized and mismatched, there is a possibility that a subframe that is different from the subframe that contains the expected date/time is being received. If this is the case, the expected code sequence may be updated based on the date/time that corresponds to the TOW count or the subframe ID, or the processing may be changed to the 3-word reception.

Besides the mismatches that occur due to the TOW count and the subframe ID, mismatches can also occur when various types of flags such as an alert flag that has the value 1, which indicates abnormal condition such as error, are included in the incoming code sequences. In this case, regardless of other conditions such as the overall number of mismatches, the subsequent processing can be carried out assuming that the expected code sequence was not matched to any of the incoming code sequences.

Modification Example 2

Next, Modification Example 2 of the date/time information reception process is described.

As described above, there is a situation in which the risk factor Pd does not become smaller than the reference risk factor Pm. This situation is possible when, even though the comparison with the expected code sequence is almost completed and the candidate for smallest mismatch count E0 (especially when this is greater than or equal to 1) is set, comparison mismatch count E2 does not become sufficiently large because the arrangement of the TOW count that indicates the present time or the like causes a code sequence similar to the expected code sequence to appear. Modification Example 2 of the date/time information reception process aims to improve the acquisition of the present date/time and reduce the power consumption in this case.

In the date/time information reception process of the present modification example, the module CPU 61 functions as a reception control unit.

Figure 7:
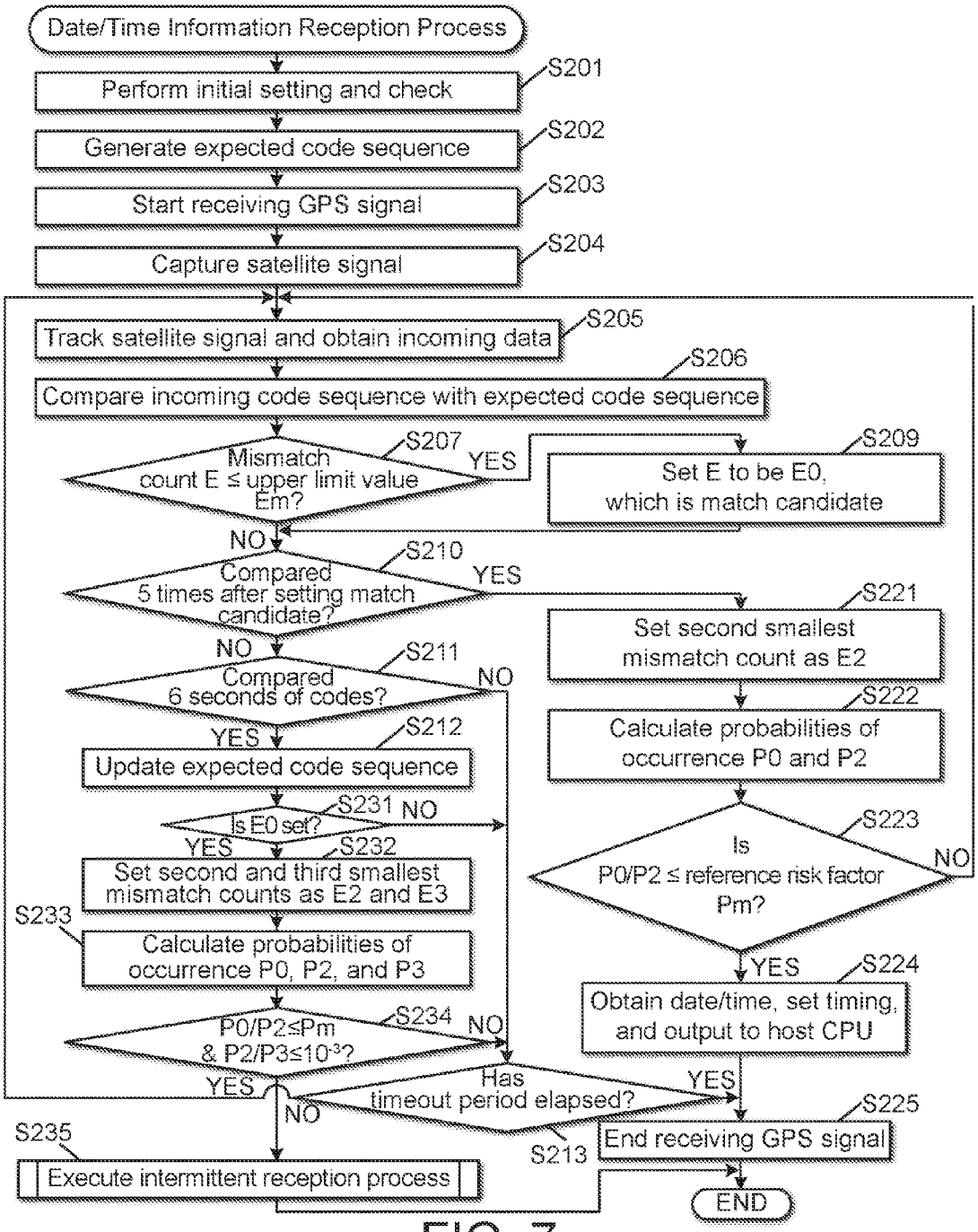
FIG. 7 is a flowchart showing Modification Example 2 of the control steps for the date/time information reception process.

FIG. 7 is a flowchart showing Modification Example 2 of the date/time information reception process.

The processes in Modification Example 2 are the same as those in the embodiment described above, except the fact that step S231 to S235 are removed, and processing contents similar to those of the embodiment described above are assigned the same reference characters and descriptions thereof are omitted.

Once the expected code sequence is updated in step S212, the module CPU 61 determines whether the candidate for the smallest mismatch count E0 is set in the most recent 6-seconds interval (corresponding to one period of the previous subframe) (step S231). If it is determined that E0 is not set ("NO" in step S231), the process in the module CPU 61 moves on to step S213. If it is determined that E0 is set ("YES" in step S231), the module CPU 61 sets the three smallest mismatch counts within the most recent 6-seconds interval as the candidate for the smallest mismatch count E0, comparison mismatch count E2, and reference mismatch count E3 (third mismatch number), respectively (step S232). If the candidate for the smallest mismatch count E0 is set multiple times (twice, for example), and none of those set values satisfies the condition in step S223, the smallest value among them will be set again as the smallest mismatch count E0, and the second smallest value becomes comparison mismatch count E2. The module CPU 61 calculates the probabilities of occurrence P0, P2, and P3 (third probability of occurrence) based on the candidate for the smallest mismatch count E0, comparison mismatch count E2, and reference mismatch count E3, respectively (step S233).

The module CPU 61 determines whether the risk factor Pd given by the ratio P0/P2 is less than or equal to reference risk factor Pm, and whether the ratio P2/P3 is less than or equal to $10^{-3}$ (second reference value) (step S234). If either of these conditions is unsatisfied ("NO" in step S234), the process in the module CPU 61 moves on step S213. If both of these conditions are satisfied ("YES" in step S234), the module CPU 61 calls up and executes an intermittent reception process (step S235), and after that, ends the date/time information reception process.

Figure 8:
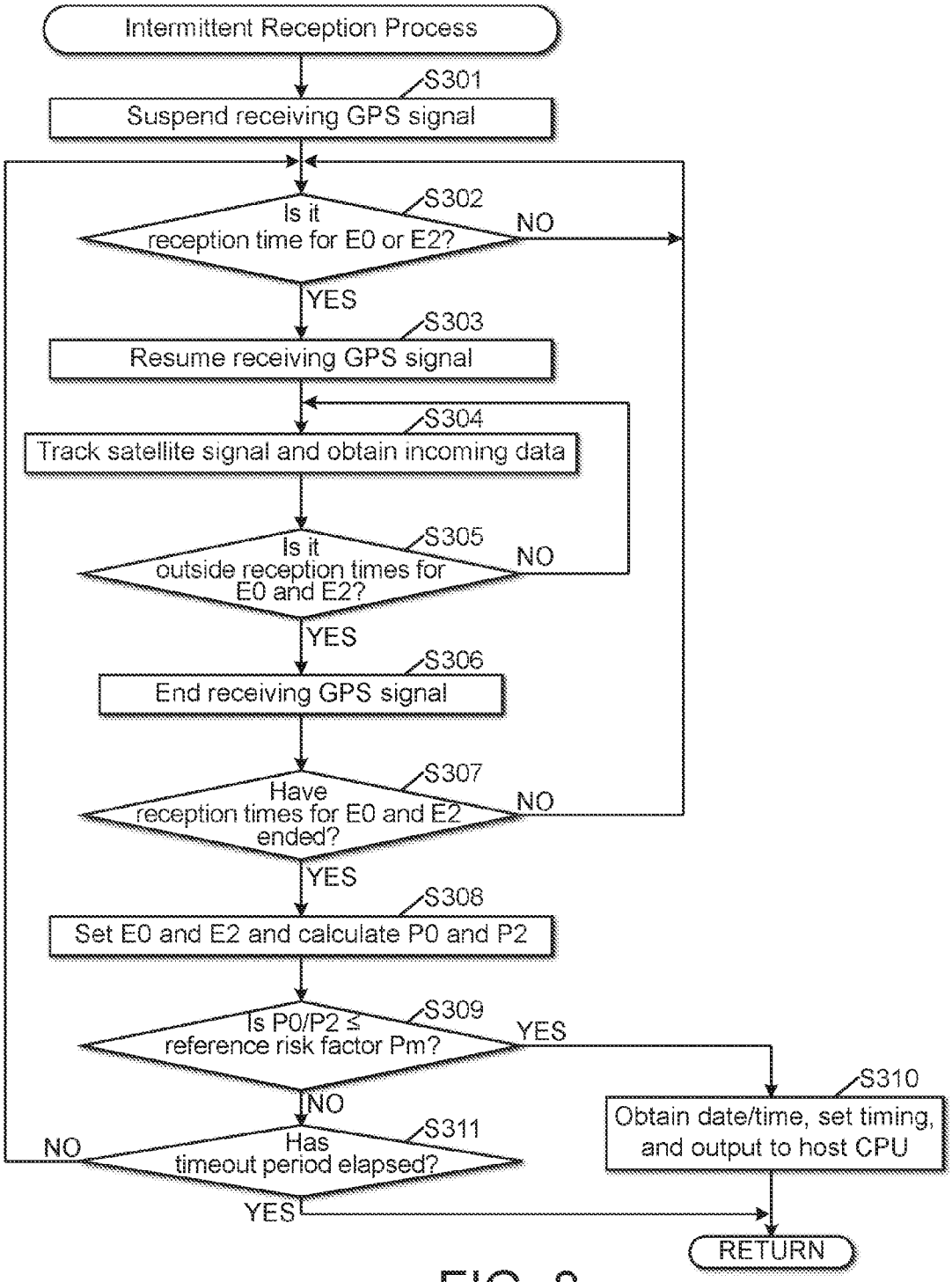
FIG. 8 is a flowchart showing control steps for an intermittent reception process.

FIG. 8 is a flowchart showing the control steps involved in the intermittent reception process called up in the date/time information reception process according to the present modification example.

Once calling up the intermittent reception process in step S235, the module CPU 61 suspends receiving the GPS signal (step S301). Two reception intervals can be defined: the reception interval during which the portion of the code sequence (first reception code sequence) that corresponds to the candidate for the smallest match count E0 was obtained, and the reception interval during which the portion of the code sequence (second reception code sequence) that corresponds to comparison match count E2 was obtained. For the subframe that is expected to be received now, the module CPU 61 determines whether the time that has elapsed since the reception (alternatively, the present date/time based on the date/time counted by the counter circuit 46) includes either of the reception intervals within a 6-seconds interval, which corresponds to the one period of the previous subframe. In other words, the module CPU determines whether the time that has elapsed since the reception is 6 seconds after either portions of the code sequence in the previous subframe. If it is determined that neither is true ("NO" in step S302), the CPU 61 repeats step S302.

If it is determined that the time that has elapsed since reception falls within the reception interval for the code sequences that correspond to either the candidate for the smallest mismatch count E0 or comparison mismatch count E2 within one period of the present subframe ("YES" in step S302), the module CPU 61 resumes receiving the radio waves from the GPS satellite (step S303). The module CPU 61 tracks the radio waves from the locked GPS satellite and obtains the incoming date that indicates demodulated code sequences (step S304).

The module CPU 61 determines whether the time that has elapsed since reception falls out of the reception time interval for the code sequences that corresponds to the candidate for the smallest mismatch count E0 and comparison mismatch count E2 (step S305). If it is determined that the time that has elapsed since reception falls within the reception intervals that correspond to either of the code sequences ("NO" in step S305), the process in the module CPU 61 goes back to step S304. If it is determined that the time that has elapsed since reception does not fall within the reception intervals that correspond to either of the code sequences ("YES" in step S305), the process in the module CPU 61 ends receiving the radio waves from the GPS satellite (step S306).

The reception intervals set here do not need to be strictly identical to the reception timings of the code sequences when the candidate for the smallest mismatch count E0 or the comparison mismatch count E2 in each subframe period were calculated. The reception intervals can be set slightly wider to include these timings accordingly.

The module CPU 61 determines whether the reception intervals of the candidate for the smallest mismatch count E0 and comparison mismatch count E2 have ended (step S307). If it is determined that the reception interval that contains the code sequence that corresponds to either mismatch counts has not ended ("NO" in step S307), the process in the module CPU 61 returns to step S302. If it is determined that the reception in each of the reception intervals has ended ("YES" in step S307), the module CPU 61 sets the smallest mismatch count and the second smallest mismatch count as the candidate for the smallest mismatch count E0 and comparison mismatch count E2, respectively. The probabilities of occurrence P0 and P2 are calculated based on these mismatch counts, respectively (step S308).

If the code sequence that corresponds to the candidate for the smallest mismatch count E0 and the code sequence that corresponds to comparison mismatch count E2 change places, they can be set as they are. If the reception interval is set on the bigger side, the module CPU 61 may compare all of the code sequences within the reception interval and perform settings for the candidate for the smallest mismatch count E0 and comparison mismatch count E2.

The module CPU 61 determines whether the risk factor Pd is less than or equal to the reference risk factor Pm (step S309). If it is determined that the risk factor Pm is not less than or equal to the reference risk factor Pm ("NO" in step S309), the module CPU 61 determines whether the timeout period has elapsed (step S311). If it is determined that the timeout period has not elapsed ("NO" in step S311), the process returns to step S302. If it is determined that the timeout period has elapsed ("YES" in step S311), the module CPU 61 ends the intermittent reception process and returns the process back to the date/time information reception process and ends the date/time information reception process.

If it is determined that the risk factor Pd is less than or equal to the reference risk factor Pm in the determination process in step S309 ("YES" in step S309), the module CPU 61 obtains the date/time that corresponds to the expected code sequence and sets that timing, and outputs the date/time information to the host CPU 41 at that timing (step S310). Then, the module CPU 61 ends the intermittent reception process.

Figure 9:
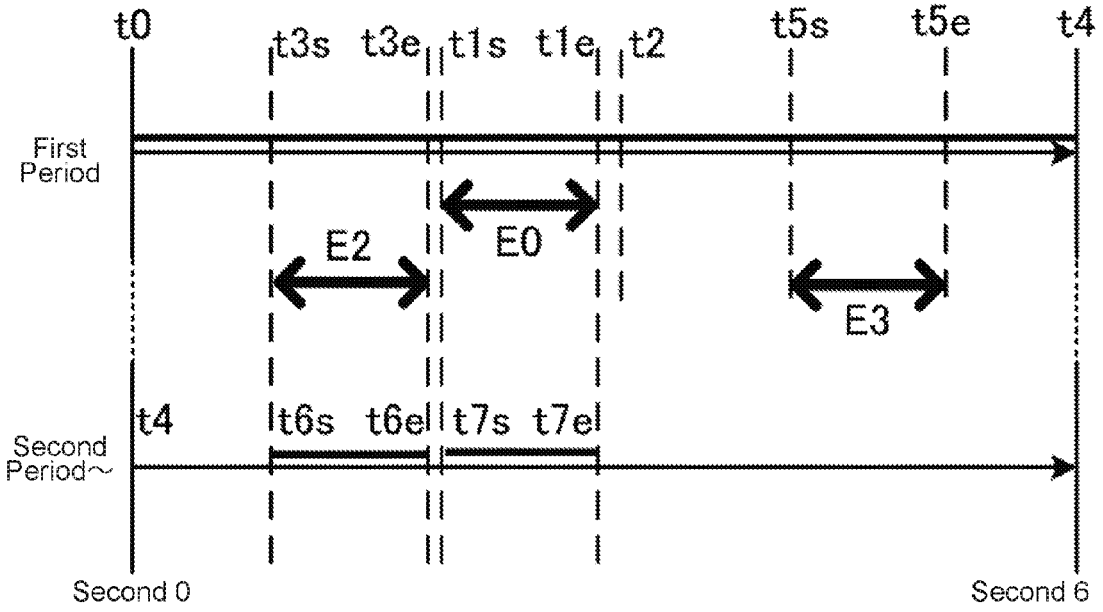
FIG. 9 is a diagram showing an example of reception intervals in the date/time information reception process and the intermittent reception process according to Modification Example 2.

FIG. 9 is a diagram showing an example of a reception interval according to the present modification example.

After performing the initial setting (step S201) and generating the expected code sequence (step S202), the module CPU 61 starts reception (step S203). Once the GPS satellite is captured (step S204), the module CPU 61 starts to obtain incoming data (step S205) and starts to compare sequentially the incoming code sequences with the expected code sequence at time t0 (step S206).

After the time interval t1*s* to t1*e* is set as the reception interval of the candidate for the smallest mismatch count E0 (steps S207 and S209), comparison mismatch count E2 and the corresponding reception interval t3*s* to t3*e* are set (step S221) at a time t2 when 5 codes are identified and compared ("YES" in step S210) and the risk factor Pd and the reference risk factor Pm are compared (steps S222 and S223). If the risk factor Pd is less than or equal to the reference risk factor Pm ("NO" in step S223), the module CPU 61 returns to step 205. At time t4, which is 6 seconds after the comparison is started ("YES" in step S211), as the expected code sequence is updated (step S212), the step branches out to "YES" in step S231 and comparison mismatch count E2, the corresponding interval (reception interval t3*s* to t3*e*) and reference mismatch count E3, in the reception interval t5*s* to t5*e* are determined (step S232). In other words, the reception in period 1 in this case continues until 6 seconds of data are compared (interval t0 to t4 indicated by the thick horizontal line in the row that represents period 1).

The interval for comparison mismatch count E2 may be different from the reception interval determined at time t2. Also, the reception interval t1*s* to t1*e* and the reception interval t3*s* to t3*e* may overlap partially.

If the probabilities of occurrence P0, P2, and P3 are calculated (step S233) and if these values satisfy the determination criteria in step S234 ("YES" in step S234), the process in the module CPU 61 moves on to step S235, and the intermittent reception process is called up. In period 2 and subsequent periods, the module CPU 61 suspends receiving radio waves from the GPS satellite (step S301) and performs reception operation only for the reception interval t7*s* to t7*e* that corresponds to the candidate for the smallest mismatch count E0 in the corresponding period and the reception interval t6*s* to t6*e* that corresponds to the comparison mismatch count E2 (the interval indicated by the thick horizontal line in the row that represents period 2~) (steps S302 to S307).

At time t7*e* when the reception of both intervals ends ("YES" in step S307), the module CPU 61 sets a new candidate for the smallest mismatch count E0 and a new comparison mismatch count E2 and computes the respective probabilities of occurrence P0 and P2 (step S308). If the risk factor Pd becomes less than or equal to the reference risk factor Pm ("YES" in step S309), it is determined that the expected code sequence is detected in the reception interval t7*s* to t7*e*, and the date/time is obtained (step S310).

As described above, the incoming code sequence that imperfectly matches the expected code sequence can be identified, but the reliability can be low due to the arrangement of the code bits. In that case, reception efficiency can be improved in the subsequent subframe periods by only receiving the matched portion and the comparison portion and only verifying the reliability based on the changes in the expected code sequence and the incoming code sequence.

As described above, the electronic watch 1 of the present embodiment is a radio-controlled timepiece that includes the RF unit 64, the baseband converter unit 65, and the capturing and tracking unit 66 of the satellite wave reception and processing unit 60 that receives satellite waves and sequentially identifies code bits encoded in a navigation message format corresponding to the satellite waves that are received and the module CPU 61. The module CPU 61 functioning as the expected code generation unit 611 generates in advance an expected code sequence that is expected to be part of the incoming code sequence consisting of at least some part of the code bits. The module CPU 61 functioning as the match detection unit 612 compares each code bit in the expected code sequence with each of the code bits in the incoming code sequence and detects the incoming code sequence having a degree of match with the expected code sequence that satisfies a prescribed reference condition. The module CPU 61 functioning as the date/time acquisition unit 613 obtains a date/time based on a timing when the incoming code sequence that satisfies the prescribed reference condition is received.

As described above, the watch can determine whether an accurate code sequence is obtained in a brief reception time, even when it is difficult to identify all the code bits accurately because of adverse signal reception condition or the like. Thus, the watch can obtain accurate date/time information more efficiently.

Also, obtaining accurate date/time by generating an expected code sequence in advance and performing comparison can reduce the time and energy needed to decode the incoming code sequences after they are received. This enables the date/time to be determined quickly.

The degree of match is determined based on the mismatch count that is obtained when comparing the code bits in the incoming code sequence with those in the expected code sequence.

Thus, whether a code sequence is identified accurately can be determined based on an easy process.

The reference condition used for the match detection is such that the risk factor Pd, the quotient obtained by dividing the probability of occurrence P0, as defined below, by the probability of occurrence P2, as defined below, is less than or equal to the reference risk factor Pm that is set in advance, where the first probability of occurrence P0 is defined as the probability that a code sequence having the candidate for the smallest mismatch count E0 with respect to the expected code sequence occurs as the incoming code sequence, and the second probability of occurrence P2 is defined as the probability that a code sequence having the comparison mismatch count E2, as defined below, with respect to the expected code sequence occurs as the incoming code sequence, and where the comparison mismatch count E2 is a smallest one among a plurality of mismatch counts each associated with a place at which the expected code sequence is compared with the incoming code sequence as the beginning of the incoming code sequence is shifted with respect to the expected code sequence from a place the candidate for the smallest mismatch count E0 was obtained up to a prescribed comparison width (5 code bits from the location where the candidate for the smallest mismatch count E0 is obtained since the comparison was started).

In other words, not only does the watch determine the expected code sequence as not matching with the incoming code sequence when the match degree is simply high but also when the degree of match is not sufficiently high with respect to other incoming code sequences. Thus, when the degree of match becomes high outside of the original match timing because the date/time is such that the TOW count and the like contains identical code bits in series, the watch can avoid determining a wrong timing as the match timing.

The probabilities of occurrence P0 and P2 can be computed by assuming that the probabilities of occurrence of 0 and 1 in each of the binary codes that form the incoming code sequence are 1/2, respectively. Thus, the deterioration of accuracy can be mostly avoided while minimizing the time and energy needed to carry out a detailed calculation.

The date/time information reception process in Modification Example 2 occurs when the candidate for the smallest mismatch count E0 is less than or equal to the reference value Em within the transmission period (the transmission period of subframes in the case of GPS satellites), which is determined by the format of the navigation message, and when the quotient obtained by dividing the probability of occurrence P0 by the probability of occurrence P2 is not less than or equal to the reference risk factor Pm. When these conditions are met, the module CPU 61 functioning as the reception control unit instructs the RF unit 64, the baseband converter unit 65, and the capturing and tracking unit 66 of the satellite wave reception processing unit 60, for each transmission period, to perform a reception during part of an interval that includes a code sequence segment that corresponds to the candidate for the smallest mismatch count E0 and a portion of a code sequence that at least corresponds to the comparison mismatch count E2 out of the code sequence segment that corresponds to the probability of occurrence for which the risk factor Pd with respect the probability of occurrence PO of the candidate for the smallest mismatch count E0 is not less than equal to the reference risk factor Pm. The module CPU 61 functioning as the match detection unit 612 compares a portion of the incoming code sequence within the part of an interval that includes at least a code sequence segment that corresponds to the candidate for the smallest mismatch count E0 and a code sequence segment that corresponds to the comparison mismatch count E2 with the expected code sequence and detects the incoming code sequence that satisfies the prescribed reference condition.

Even though the incoming code sequence that mostly matches with the expected code sequence is identified, it is possible for comparison mismatch count E2 not to become large because of the way the code bits are arranged and the reliability of the identified location to be low. In this case, after the next subframe period, the identified location can be verified while reducing reception-related power consumption by receiving only the matched portion and the comparison portion of the incoming code sequence and by conducting only the verification of the reliability when the expected code sequence and the incoming code sequence change. This can improve the reception efficiency.

The module CPU 61 functioning as the reception control unit instructs the RF unit 64, the baseband converter unit 65, and the capturing and tracking unit 66 of the satellite wave reception processing unit 60 to receive the satellite waves during part of an interval that includes the code sequence segment that corresponds to the candidate for the smallest mismatch count E0 and the code sequence segment that corresponds to the comparison mismatch count E2 when a third probability of occurrence P3 of the reference mismatch count E3 is greater than $10^3$, where the reference mismatch count E3 is the second smallest one among a plurality of mismatch counts that occur as the beginning of the incoming code sequence is shifted from a place where the candidate for the smallest mismatch count E0 was obtained up to the comparison width.

As described, a code sequence that is similar to the expected code sequence may appear in other locations within the incoming code sequence comparison by accident because match count E2 has a sufficiently small value with respect to match counts that correspond to other incoming code sequences except the candidate for the smallest match count E0. In this case, all that is needed is to check after the next subframe period that the similar code sequence is not located at a position where the sequence matches with the expected code sequence, and unnecessary reception and comparison are not performed. Thus, the incoming code sequence that matches with the expected code sequence can be detected efficiently and reliably.

The second reference value is determined by the ratio of probability of occurrence P3 to probability of occurrence P2. Thus, the possibility that the portion of the code sequence other than the portion of the code sequence that corresponds to comparison mismatch count E2 is at the exact location that matches with the expected code sequence can be eliminated.

Also, the reference condition can be set by the upper limit of mismatch count, and the exact match timing can be obtained by a simple determination process without use of division or the like.

In this case, the upper limit of mismatch count is set such that the probability, with respect to the expected code sequence, that a code sequence that results in the maximum upper limit appears as the incoming code sequence is below the third reference value. Thus, the probability of misidentification can be contained within a desired range in accordance with product life cycle or use.

This probability of occurrence can be computed by assuming that the probabilities of occurrence of 0 and 1 in each of the binary codes that form the incoming code sequence are 1/2, respectively. Thus, in a manner similar to the probabilities of occurrence P0 and P2, the deterioration of accuracy can be avoided while minimizing the time and energy needed to carry out a detailed calculation.

The watch is equipped with the counter circuit 46. The module CPU 61 functioning as the expected code sequence generation unit 611 generates an expected code sequence that includes at least a prescribed number of code bits from the side of the least significant bit that are part of code sequences such as the TOW count or the subframe ID that correspond to the present time, which is updated every transmission period (the transmission period of subframes in the case of the GPS satellites) that is determined according to the navigation message format. Thus, the watch can reliably detect an error that occurs when the reception timing is off in units of transmission periods (subframes) and also estimate the magnitude of the error.

The time-related code bits in the expected code sequence and the received code sequence that are compared can mismatch. In this case, the module CPU 61 functioning as the match detection unit 612 can avoid obtaining inaccurate unexpected date/time by considering the possibility of such a misalignment in units of transmission periods and determining that the degree of match between the incoming code sequence and the expected code sequence does not satisfy the predetermined reference condition.

The degree of match that is calculated by shifting the head code location of the incoming code sequence with respect to the head code location of the expected code sequence by at least a bit count of 300 may not satisfy the predetermined reference condition. In that case, the module CPU 61 functioning as the expected code sequence generation unit 611 updates the expected code sequence as the date/time information changes to a value that is estimated for the next subframe. Thus, even in the case when the match timing is not detected because the detection of the match timing was carried out when the reception condition within the subframe was terrible, the detection can be carried out in the next subframe accordingly.

The module CPU 61 functioning as the expected code sequence generation unit 611 generates an expected code sequence that includes an invariant code sequence such as a preamble and reserved bits, which are transmitted every subframe period that is set according to the navigation message format. The invariant code sequence can be used for the expected code sequence easily regardless of the intervals between receptions and to extend the bit length. Thus, concerns about misidentification can be reduced. The invariant code sequence like this includes many bits that become mismatched when the top positions of the expected code sequence and the incoming code sequence differ by less than the length of the invariant code sequence. Thus, in contrast to a TOW count or the like, the chance of misidentification due to date/time does not increase.

The electronic watch is equipped with the history storage unit 632, which stores the reception history of the most recent satellite waves, and the code storage unit 633, which stores the code sequence that is obtained during the reception of the most recent satellite waves as a logged code sequence. The module CPU 61 functioning as the expected code sequence generation unit 611 determines which part of the logged code sequence does not change within the time that has elapsed since the reception of the most recent satellite waves and includes at least a portion of this part in the expected code sequence. This determination is based on the types of data in the logged code sequence. In this way, code sequences such as a telemetry word or an almanac, which are not necessarily predictable but expected not to change in a short period of time, can be stored in the code storage unit 633 and used for the expected code sequence. In this way, the bit length of the expected code sequence can be extended easily, and the possibility of misidentification can be reduced.

The satellite waves are transmitted from the GPS satellite, and the logged code sequence includes a telemetry message. Thus, using a code sequence that is not expected to change in a short period of time as described above, the expected code sequence can be extended by 14 bits in an efficient manner.

When the expected code sequence does not match with the code bits in the incoming code sequence, the expected code sequence includes a flag or the like that indicates that the preset reference condition is not satisfied, which is determined by the module CPU 61 functioning as the match detection unit 612. Thus, when there is a transmission error from the GPS satellite, the normal processing can be stopped.

The expected code sequence includes at least a portion of a TOW count and a portion of a subframe ID, each of which changes in a similar manner as the date/time change. The parts of the expected code sequence that respectively corresponds to these portions may not match with the incoming code sequence at the same time because of the values that correspond to change in date/time. In that case, the module CPU 61 functioning as the match detection unit 612 determines that the predetermined condition is not satisfied. Thus, even when other conditions such as the overall mismatch count are satisfied, it can be assumed that there is a possibility that there is a problem such as an error in units of subframes. To be absolutely on the safe side, misidentification can be avoided by doing things like switching to a more reliable reception method.

The TOW count and the subframe ID can be mismatched with the incoming code sequence at the same time because of change in date/time. In this case, the module CPU 61 functioning as the expected code sequence generation unit 611 can update the expected code sequence according to the date/time that all parts of the mismatched incoming code sequence indicate. In this way, when a shift in units of subframes is possible, accurate date/time can be obtained quickly by re-generating an expected code sequence by taking the shift in units of subframes into account and by determining the degree of match.

By using the method of obtaining date/time information described above, accurate date/time information can be obtained efficiently in a similar manner, even in a situation such as when a plurality of electronic devices or CPUs are used together to obtain date/time.

By installing programs that correspond to the method of obtaining date/time information described above in electronic devices that can receive satellite waves from positioning satellites and using those programs, a wide range of electronic devices can be made to obtain accurate date/time information in an efficient manner.

The present invention is not limited to the embodiments described above, and a various types of modifications are possible.

Although the embodiments described above used a configuration in which the module CPU 61 conducted various processes related to obtaining date/time as an example for description, the processing may be conducted by the host CPU 41. Alternatively, the module CPU 61 and the host CPU 41 may share the processes, each carrying out some portions thereof. Accompanying the above, a part or whole of the most recent reception history and the code sequences that are received may be stored in the non-volatile memory portion of the RAM 43 instead of the storage portion 63 of the satellite wave reception and processing unit 60.

Also, the length of the expected code sequence indicated in the embodiments described above may be changeable according to circumstances. The length of the expected code sequence may be shortened along with the timeout period in accordance with the battery capacity, for example. When the elapsed time since the last reception date/time that is obtained in step S201 is sufficiently small, and the expected shift is about a few bits, the possibility that the preamble, which is an invariant code sequence, is misidentified becomes very small, for example. In that case, only the preamble may be set as the code sequence, and date/time may be obtained using the timing when the expected code sequence perfectly matches with the incoming code sequence. In this case, an expected code sequence that is longer than 8 bits can be tentatively set in the process in step S202, and only when the reception signal strength of radio waves from the GPS satellite that is captured in step S204 is stronger than the reference level, the expected code sequence may be changed to include only the preamble.

In a similar manner, the reference value Em can be changed according to other criteria such as reception signal strength. The situation in which many code bits are misidentified even when the signal strength (S/N ratio) of the radio waves from the GPS satellite captured in step S204 is sufficiently large is rare. Thus, lowering reference value Em as the S/N ratio increases can lower the probability of misidentifications, which occurs when matches with similar code sequences that appear in other locations happen.

Although embodiments described above used a situation in which the ratio of the probabilities P0 and P2 is used and a situation in which the candidate for the smallest mismatch count E0 is used as an example for description, other determination criteria may also be used. To carry out the determination, the upper limit of the candidate for the smallest mismatch count E0 and the lower limit of comparison mismatch count E2 may be set, for example.

Also, in the embodiments described above, comparison mismatch count E2 was obtained after the candidate for the smallest mismatch count E0 was obtained and further after 5 bits of the incoming code sequence were obtained. However, the present invention is not limited to this. Only the comparison result that was already obtained at the time when the candidate for the smallest mismatch count E0 was obtained may be used. Alternatively, the comparison count after the candidate for the smallest mismatch count E0 may be determined according to the comparison count since the comparison started. Regarding use of the comparison result prior to setting the candidate for the smallest mismatch count E0, neither the entire portion thereof since the start of the comparison nor the portion thereof that corresponds to the most recent subframe need to be used. Instead, other ranges may be set appropriately.

Furthermore, in Modification Example 2, the intermittent reception process was carried out if comparison mismatch count E2 was sufficiently small with respect to the mismatch count related to the other comparison results, but the present invention is not limited to this. If there are a plurality of incoming code sequences, each of which has a mismatch count that does not make the probability of occurrence thereof sufficiently large with respect to the probability of occurrence P0, the reception time may be set such that the reception time of one subframe period in and after period 2 can be shorted while including a part or whole of the plurality of incoming code sequences.

In the embodiments described above, the estimated timing of reception was decided from the beginning, and accurate date/time was obtained using only the timing error. However, date/time information may be obtained by comparing the code sequences and decoding the code sequence for which match is verified.

Also, the embodiments above used the radio wave reception from the GPS satellites as an example for description. However, the radio waves from satellites related to navigation systems other than the GPS such as the GLONASS of Russia or the Galileo of Europe may be used, and comparisons with code sequences that correspond to respective formats may be carried out. The present invention can be applied to incoming radio waves from the quasi-zenith satellites of Japan, which transmit radio waves that are based on the GPS. When receiving and using radio waves from the GLONASS satellites, the transmission time of a string (2 seconds) may be taken as the transmission period, and the string number can be used as time-relevant information.

The embodiments above described the correspondence between a subframe ID and a TOW count, but other parts such as the correspondence between orbital information (ephemeris) and approximate orbital information (almanac) may also be used.

The embodiments above used an analog electronic watch as an example for description. However, a digital electronic watch, or alternatively the combination of the two, may also be used.

The settings for the reference condition shown in the embodiments described above can be used individually or in combination in an arbitrary manner depending on circumstances. The elements of determination condition expressed as the date/time information reception process in the two flow charts may be removed or replaced, or new elements may be added.

The description above used as an example the storage unit 63 made of non-volatile memory as a computer-readable medium for operation processing programs related to measurements such as the time zone calculation processing related to the processing operations of the module CPU 61 according to the present invention, but the present invention is not limited to this.

A portable storage medium such as a HDD (hard disk drive), a CD-ROM, or a DVD disk can be used as an alternative computer-readable medium. As a medium that provides program data related to the present invention via telecommunication lines, a carrier wave is applicable to the present invention.

Besides what is described above, the specific configurations shown in the embodiments described above, the contents and steps of operations, and the like can be appropriately modified without departing from the spirit of the invention.

Several embodiments of the present invention were described, but the scope of the present invention is not limited to these and includes the scope of the invention as described in the claims and the equivalents thereto.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A radio-controlled timepiece, comprising:

a radio wave reception unit that receives satellite waves and extracts an incoming code sequence formatted in a prescribed format from said received satellite waves; and a processor that generates in advance an expected code sequence that is expected to be part of said incoming code sequence and detects a matching code sequence segment, within said incoming code sequence, that has a degree of match with the expected code sequence that satisfies a prescribed matching condition, the processor determining a present date/time, as indicated by the satellite waves, in accordance with a timing at which said detected matching code sequence segment occurs within said incoming code sequence as measured by time kept by the timepiece.

2. The radio-controlled timepiece according to claim 1, wherein said degree of match is determined by comparing respective code bits in said expected code sequence with corresponding code bits in said incoming code sequence and determining a mismatch count in said comparison.

3. The radio-controlled timepiece according to claim 2, wherein said prescribed matching condition is such that said mismatch count for said matching code sequence segment, which is defined as a first mismatch count, is less than or equal to a prescribed maximum value, and that a quotient obtained by dividing a first probability of occurrence, as defined below, by a second probability of occurrence, as defined below, is less than or equal to a first reference value, wherein said first probability of occurrence is defined as a probability that an arbitrarily chosen code sequence segment with a same length as the expected code sequence has said first mismatch count with respect to the expected code sequence, and said second probability of occurrence is defined as a probability that an arbitrarily chosen code sequence segment with a same length as the expected code sequence has a second mismatch count, as defined below, with respect to the expected code sequence, and wherein said second mismatch count is a smallest one among a plurality of mismatch counts of code sequence segments that are compared with the expected code sequence within a prescribed range in said incoming code segment from the said matching code sequence segment that has said first mismatch count.

4. The radio-controlled timepiece according to claim 3, wherein said first probability of occurrence and said second probability of occurrence are calculated by assuming that, in each of binary codes that constitute said incoming code sequence, a probability that 0 occurs and a probability that 1 occurs are 1/2, respectively.

5. The radio-controlled timepiece according to claim 3, wherein said processor instructs, when said quotient obtained by dividing said first probability of occurrence by said second probability of occurrence is not less than or equal to said first reference value for the matching code sequence segment that has said first mismatch count less than the prescribed maximum value, said radio wave reception unit to receive subsequent satellite waves during a portion or portions of a next transmission period such that a resultant newly extracted incoming code sequence or sequences include a first code sequence that corresponds to a code sequence segment in a current incoming code sequence from which said first mismatch count is obtained and a second code sequence segment that corresponds to a code segment in the current incoming code sequence from which said second mismatch count is obtained, and wherein said processor compares said expected code sequence with said first code sequence segment and said second code sequence segment, respectively, and determines whether said prescribed condition is satisfied for the first and second code sequence segments included in the newly extracted incoming code sequence or sequences.

6. The radio-controlled timepiece according to claim 5, wherein said processor instructs said radio wave reception unit to receive said subsequence satellite waves during said portion or portions of said next transmission period when a third probability of occurrence, as defined below, is greater than a second reference value, and wherein said third probability of occurrence is defined as a probability that an arbitrarily chosen code sequence segment with a same length as the expected code sequence has a third mismatch count with respect to the expected code sequence, said third mismatch count being defined as a second smallest one among the plurality of mismatch counts of the code sequence segments that are compared with the expected code sequence within the prescribed range in said incoming code sequence from the said matching code sequence segment that has said first mismatch count.

7. The radio-controlled timepiece according to claim 6, wherein said second reference value is a value obtained by multiplying said second probability of occurrence by a prescribed number.

8. The radio-controlled timepiece according to claim 2, wherein said prescribed matching condition is that said mismatch count is less than or equal to a prescribed upper limit.

9. The radio-controlled timepiece according to claim 8, wherein said upper limit for said mismatch count is determined such that a probability that an arbitrarily chosen code sequence segment with a same length as the expected code sequence has a mismatch count equal to said upper limit with respect to the expected code sequence is less than or equal to a prescribed reference value.

10. The radio-controlled timepiece according to claim 9, wherein said probability of occurrence is computed by assuming that, in each of binary codes that constitute said incoming code sequence, a probability that 0 occurs and a probability that 1 occurs are 1/2, respectively.

11. The radio-controlled timepiece according to claim 1, further comprising:

a counter unit that counts a date/time of said radio-controlled timepiece, wherein said processor generates, based on said date/time counted by said counter unit, said expected code sequence that includes a prescribed number of lower bits, inclusive of a least significant bit, of a series of bits that represent, in said prescribed format, a present time that is updated at each transmission period.

12. The radio-controlled timepiece according to claim 11, wherein said processor determines that said degree of match between said incoming code sequence and said expected code sequence does not satisfy said prescribed matching condition when a mismatch occurs in any one of said prescribed number of lower bits of the series of bits that represent the present time.

13. The radio-controlled timepiece according to claim 11, wherein said processor updates said expected code sequence in accordance with changes in said present time as updated when a code sequence segment that satisfies the prescribed matching condition is not found by shifting a beginning of a candidate code sequence segment that is compared with the expected code sequence until said shift is greater than or equal to a number of code bits that corresponds to said transmission period.

14. The radio-controlled timepiece according to claim 1, wherein said processor generates said expected code sequence that includes an invariant code sequence that does not change with transmission period, set forth by the prescribed format.

15. The radio-controlled timepiece according to claim 1, further comprising:

a storage unit that stores a reception history of most recently received satellite waves and a code sequence that is obtained from said most recently received satellite waves as a logged code sequence, wherein said processor determines, in accordance with types of information in said logged code sequence, a portion of said logged code sequence that does not change within a time interval between when said most recently received satellite waves were received and a present moment and includes at least a portion of said portion of said logged code sequence in said expected code sequence.

16. The radio-controlled timepiece according to claim 15, wherein said satellite waves are transmitted from a Global Positioning Satellite, and said logged code sequence includes a telemetry message.

17. The radio-controlled timepiece according to claim 1, wherein said expected code sequence includes a plurality of code sequence portions that change in accordance with prescribed rules, and wherein said processor determines that said prescribed matching condition is not satisfied when none of said code sequence portions matches with a candidate code sequence segment.

18. The radio-controlled timepiece according to claim 17, wherein said plurality of code sequence portions include a Time of Week (TOW) count and a subframe ID, and when the TOW and the subframe ID are not matched with corresponding code segments in the expected code sequence, the processor updates the TOW and the subframe ID in accordance with the prescribed rules.

19. A method of determining date/time information in a radio-controlled timepiece that has a radio wave reception unit that receives satellite waves, the method comprising:

extracting an incoming code sequence that is formatted in a prescribed format from said received satellite waves;

generating in advance an expected code sequence that is expected to be part of said incoming code sequence;

detecting a matching code sequence segment, within said incoming code sequence, that has a degree of match with the expected code sequence that satisfies a prescribed matching condition; and determining a present date/time, as indicated by the satellite waves, in accordance with a timing at which said detected matching code sequence segment occurs within said incoming code sequence as measured by time kept by the timepiece.

20. A non-transitory storage medium that stores instructions executable by a processor communicating with a radio wave reception unit that receives satellite waves, said instructions causing the processor to perform the following:

extracting an incoming code sequence that is formatted in a prescribed format from said received satellite waves;

generating in advance an expected code sequence that is expected to be part of said incoming code sequence;

detecting a matching code sequence segment, within said incoming code sequence, that has a degree of match with the expected code sequence that satisfies a prescribed matching condition; and determining a present date/time, as indicated by the satellite waves, in accordance with a timing at which said detected matching code sequence segment occurs within said incoming code sequence as measured by time kept by the processor.

* * * * *